United States Patent [19]

Takigawa et al.

[11] Patent Number: 4,484,443

[45] Date of Patent: Nov. 27, 1984

[54] CONTROL SYSTEM FOR SUPERHIGH PRESSURE GENERATION CIRCUIT

[75] Inventors: Toshiji Takigawa, Osaka; Akira Sakamoto; Ryuji Takahashi, both of Tokyo, all of Japan

[73] Assignees: Sumitomo Metal Industries, Ltd., Osaka; Kayaba Kogyo Kabushiki Kaisha, Tokyo, both of Japan

[21] Appl. No.: 312,438

[22] Filed: Oct. 16, 1981

[30] Foreign Application Priority Data

Oct. 20, 1980 [JP] Japan ..... 55-146472

[51] Int. Cl.[3] ..... B60T 17/22

[52] U.S. Cl. ..... 60/534; 60/538; 60/545; 60/593; 91/39; 91/361

[58] Field of Search ..... 60/537, 538, 534, 593, 60/545; 91/39, 35, 361

[56] References Cited

U.S. PATENT DOCUMENTS

| | | | |
|---|---|---|---|
| 2,403,912 | 7/1946 | Doll | 60/538 |
| 3,093,971 | 6/1963 | Van Deberg | 60/537 |
| 3,613,505 | 10/1971 | Bubula | 91/35 |
| 3,702,057 | 11/1972 | Rabiger | 60/538 |
| 3,752,282 | 8/1973 | Espenshied | 60/538 |
| 4,037,519 | 7/1977 | Miller | 91/35 |
| 4,208,879 | 6/1980 | Segawa | 60/593 |

*Primary Examiner*—Abraham Hershkovitz
*Attorney, Agent, or Firm*—Jordan and Hamburg

[57] ABSTRACT

A control system for a superhigh pressure generation circuit includes a hydraulic pump having a usual range of delivery pressure. An electrohydraulic servo valve controls the flow rate of pressurized fluid from the pump and supplies it to a primary side of a boost cylinder. A stepped piston slidably received in the boost cylinder strokes in response to the input fluid to generate a fluid pressure elevated in accordance with an effective sectional area ratio of the stepped piston in a secondary side of the boost cylinder. The fluid pressure in the secondary side is caused to coincide accurately with a reference pressure level on the basis of a feedback control.

10 Claims, 8 Drawing Figures

CONTROL SYSTEM FOR SUPERHIGH PRESSURE GENERATION CIRCUIT

BACKGROUND OF THE INVENTION

The present invention relates to a control system for a superhigh pressure generation circuit which generates a superhigh hydraulic fluid pressure and maintains the fluid pressure at a preselected level.

In rolling blanks of iron and steel or those of nonferrous materials such as aluminum and copper, it is a prerequisite that the rolling mill processes a blank to a uniform thickness. However, a blank tends to become thicker in a laterally intermediate portion than the rest due to an inherent construction of a rolling mill. A rolling load is applied to a blank from bearing sections at opposite ends of upper and lower rolls with the result that the axes of the upper and lower rollers are bend away from each other with the maximum distance defined substantially at a midpoint between the bearings. Such a tendency is particularly pronounced in a cold rolling mill which exerts a very heavy rolling load onto blanks. The resultant uneven thickness distribution over the width of a blank significantly degrades the quality of a product.

An expedient to establish a uniform inter-roll linear pressure by compensating for the curvatures of the roll axes is disclosed in Japanese Patent Publication No. 46-43978. This prior art expedient employs sleeves or crowns coupled individually around upper and lower rolls and feeds high pressure hydraulic fluid to between each roll and crown, so that the opposite crowns become bulged toward each other in their intermediate portions between the bearings.

For the variable crowns to be so deformed, the rolling mill has to be supplied with a fluid pressure as high as about 500 kg/cm$^2$ at the maximum, for example. Use of an ordinary hydraulic circuit for the generation of such a high pressure is impractical, however, unless all the components thereof such as a hydraulic pump for generating a fluid pressure, a relief valve for controlling the fluid pressure to a given level, an accumulator for temporary accumulation of the fluid pressure, pipings for induction of the fluid pressure and a check valve for checking reverse flows are designed to fully withstand the high pressure. This obstructs the use of existing industrial hydraulic instruments and requires very expensive parts for exclusive use.

Meanwhile, after a desired high pressure has been reached, a major part of delivery from the high pressure pump is relieved. This brings about another problem that a substantial load necessary for driving such a high pressure pump accompanies a significant loss in the driving energy.

Additionally, the accuracy in the control on the high pressure is limited due to uneven characteristic distributions among relief valves.

SUMMARY OF THE INVENTION

A control system for a superhigh pressure generation circuit embodying the present invention comprises a pressure setting unit which produces an electric signal representing a preselected pressure, an electrohydraulic servo valve for controlling an amount of fluid supply from a hydraulic fluid source in response to an output signal of the pressure setting unit, a boost cylinder having a primary cylinder, a secondary cylinder integral with the primary cylinder and a stepping piston including a first piston portion and a second piston portion, boost cylinder being constructed to generate a high fluid pressure in the secondary cylinder in response to fluid admitted into the primary cylinder from the servo valve in accordance with the ratio in effective sectional area between the first and second piston portions, a pressure sensor sensitive to a fluid pressure in a high pressure supply line into which the generated high pressure is introduced, the pressure sensor being constructed to feed the sensed pressure back to the servor valve, and a sequence circuit which, when the piston in the boost cylinder reaches an end of a forward or inward stroke thereof, closes a shut-off valve disposed in the high pressure supply line and so switches the fluid pressure in the primary cylinder as to return the piston back to an initial position thereof.

In accordance with the present invention a control system for a superhigh pressure generation circuit includes a hydraulic pump having a usual range of delivery pressure. An electrohydraulic servo valve controls the flow rate of pressurized fluid from the pump and supplies it to a primary side of a boost cylinder. A stepped piston slidably received in the boost cylinder strokes in response to the input fluid pressure to generate a fluid pressure elevated in accordance with an effective section area ratio of the piston in a secondary side of the boost cylinder. The fluid pressure in the secondary side is caused to coincide accurately with a reference pressure level on the basis of a feedback control.

It is an object of the present invention to provide a system which generates a superhigh pressure relying not on a high pressure pump but on a hydraulic pump of a usual range of delivery pressure.

It is another object of the present invention to provide a system which controls a generated superhigh pressure accurately to a preselected reference level.

It is another object of the present invention to provide a system which minimizes a power loss in the drive of a pump.

Other objects, together with the foregoing, are attained in the embodiments described in the following description and illustrated in the accompanying drawings.

DESCRIPTION OF THE PREFERRED EMBODIMENTS

While the control device for a superhigh pressure circuit of the present invention is susceptible of numerous physical embodiments, depending upon the environment and requirements of use, substantial numbers of the herein shown and described embodiments have been made, tested and used, and all have performed in an eminently satisfactory manner.

Figure 1:
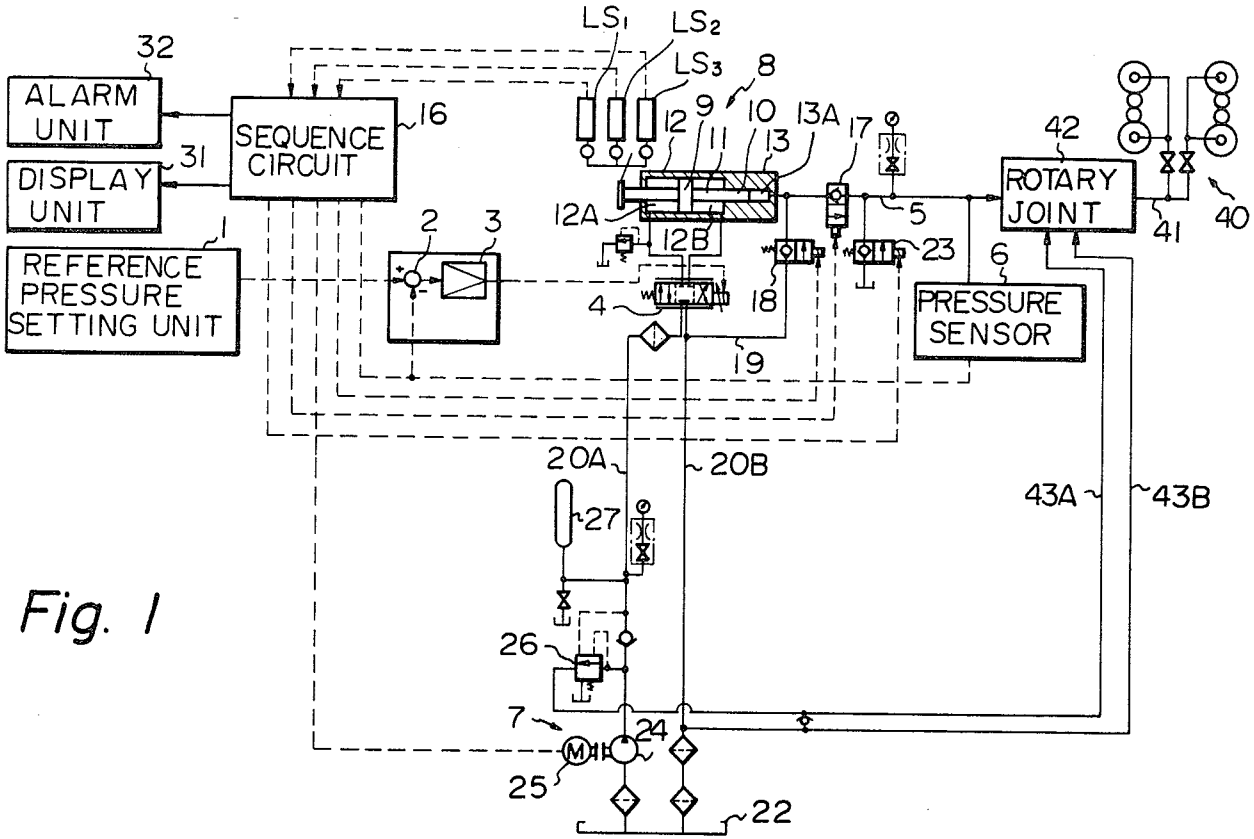
FIG. 1 is a diagram showing a hydraulic circuit embodying the present invention.
Figure 2A:
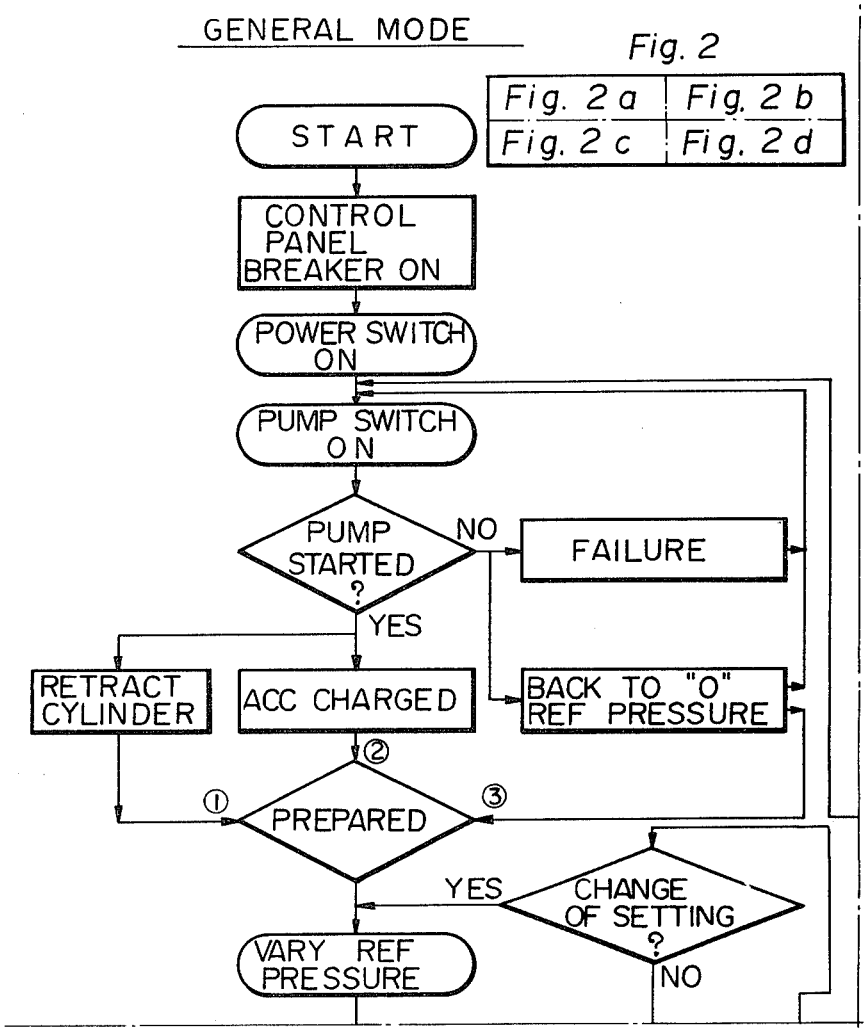
FIGS. 2 and **2*a*–2*d* are flowcharts demonstrating operations of a sequence circuit in accordance with the present invention.
Figure 2B:
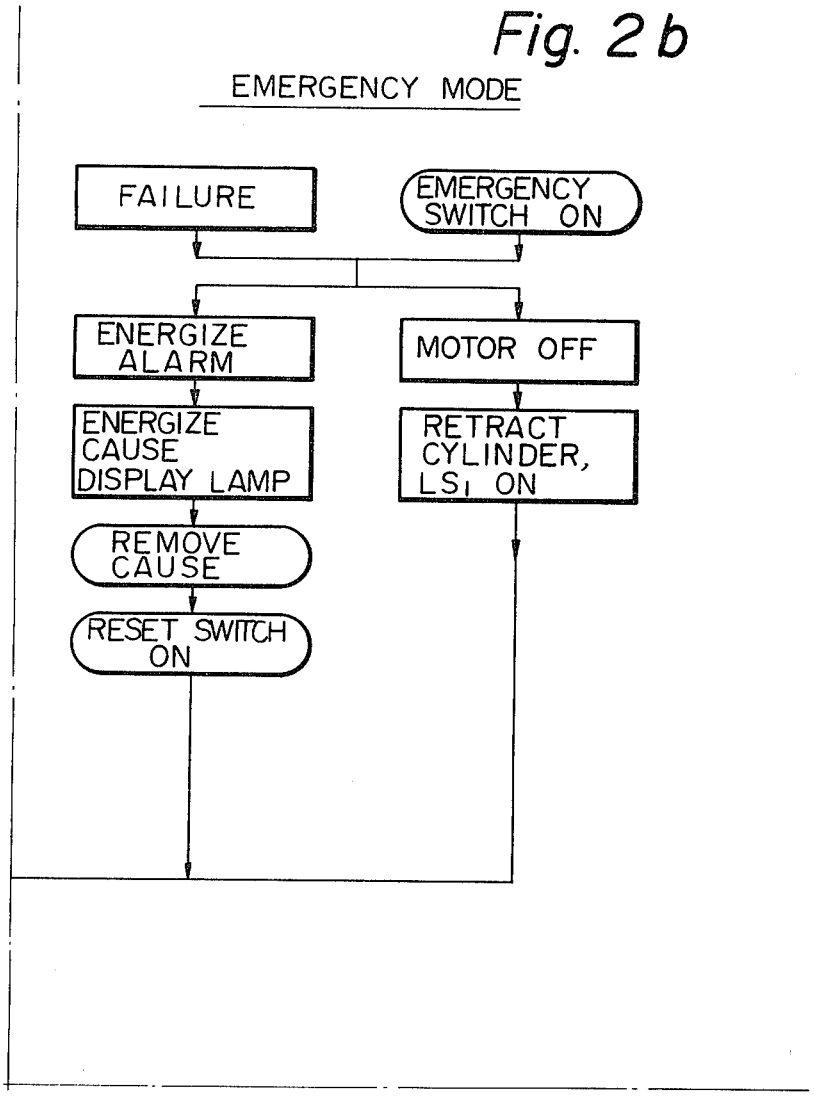
Figure 2C:
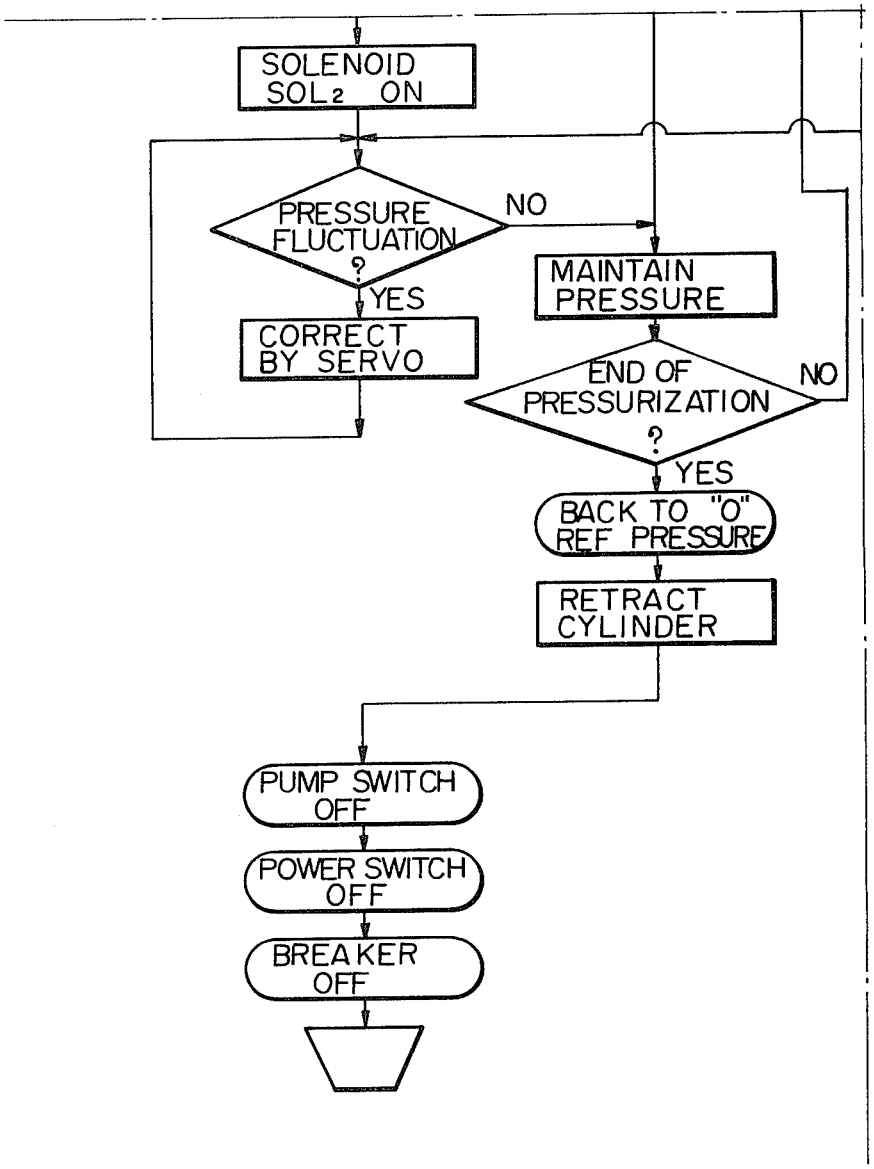
Figure 2D:
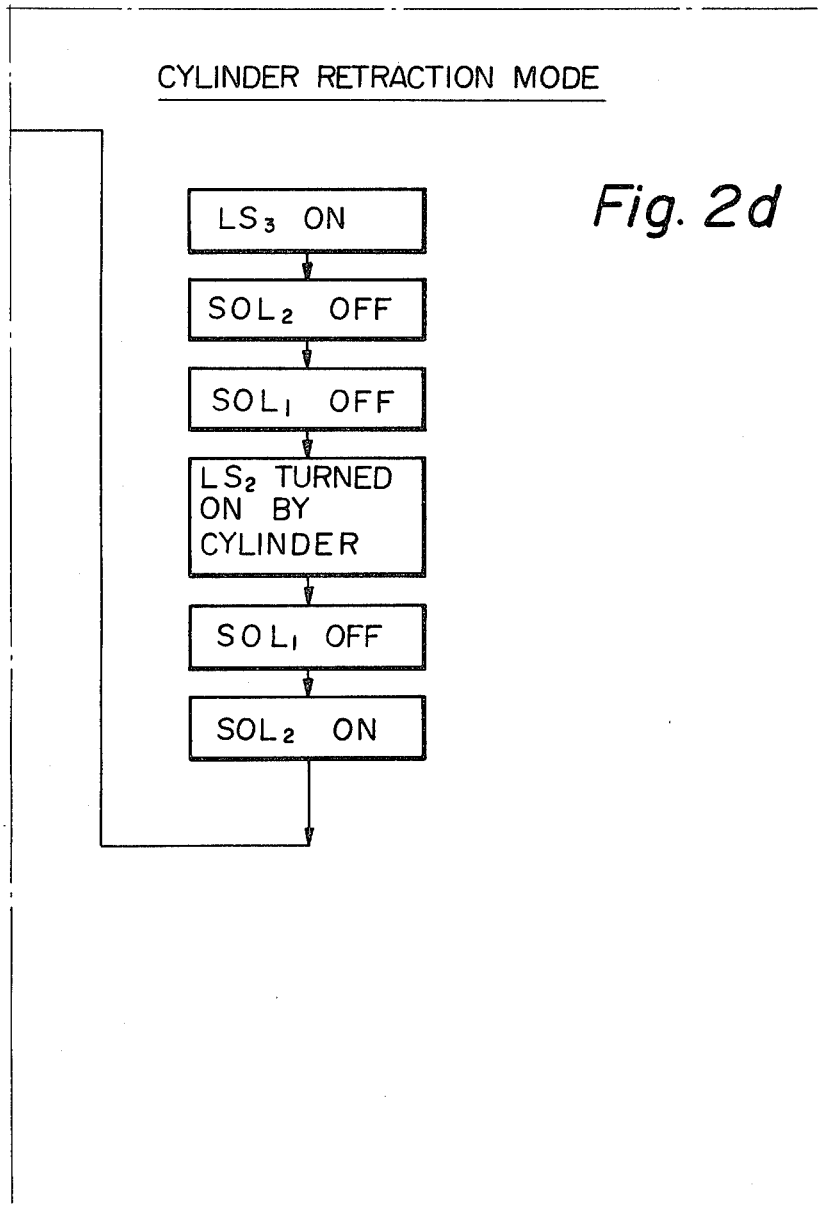

Referring to FIG. 1 of the drawings, the reference numeral 1 designates a reference pressure setting unit adapted to determine a target or reference pressure and deliver an electric signal indicative of the reference pressure. The output of the unit 1 is coupled through an adder 2 to a servo amplifier 3 and therefrom to an electrohydraulic servo valve 4 as a drive signal.

A pressure sensor 6 senses an actual pressure developing in a high pressure supply line 5 as will be described. The output of the pressure sensor 6 is fed back to the adder 2 so that a signal representing a difference between the actual pressure and the reference pressure will be coupled to the servo valve 4. In accordance with this input signal, the servo valve 4 controls the amount of hydraulic fluid to be supplied from a hydraulic fluid source 7 to a primary side of a boost cylinder 8.

The boost cylinder 8 is adapted to proportionally elevate a relatively low fluid pressure supplied thereto from the fluid source 7. For this purpose, the boost cylinder 8 comprises a stepped piston 11 having a first piston portion 9 and a second piston portion whose diameter is smaller than that of the first 9. The larger diameter piston portion 9 and smaller diameter piston portion 10 are slidably received in a primary cylinder 12 and a secondary cylinder 13, respectively. The piston portion 9 defines two fluid chambers 12A and 12B on both sides thereof in cooperation with the primary cylinder 12. The fluid from the servo valve 4 is selectively communicatable to the fluid chambers 12A and 12B thereby driving the stepped piston 11 in a desired direction. The piston portion 10 which is of the single-acting type defines a single fluid chamber 13A in combination with the secondary cylinder 13. This fluid chamber 13A is in hydraulic connection with the high pressure supply line 5.

When the fluid is fed from the fluid source 7 to the left chamber 12A in the primary cylinder 12 under a given pressure, it acts on the piston portion 9 to move the piston 11 bodily to the right in the drawing. Then, the piston portion 10 is caused to force the fluid out of the chamber 13A in the secondary cylinder 13 to the high pressure supply line 5. During the course of this action, the servo valve 4 functions to control the flow rate of the fluid from the fluid source 7 to the primary cylinder 7.

At this instant, the pressure inside the fluid chamber 13A is a version of the input primary pressure to the fluid chamber 12A which was elevated in accordance with the ratio in effective sectional area between the piston portions 9 and 10.

A sequence circuit 16 is connected with limit switches $LS_1$, $LS_2$ and $LS_3$ in order to continuously control the operation of the booster 8. The limit switches $LS_1$–$LS_3$ are responsive to predetermined stroking positions of the stepped piston 11, respectively. The outputs of these limit switches are supplied to the sequence circuit 16.

A discharging or pressurizing operation of the boost cylinder 8 terminates when the piston 11 strokes up to the rightmost maximum advanced position. For another discharge, the piston 11 has to be returned to the initial or intermediate position.

A shut-off valve 17 is disposed in the high pressure supply line 5 to prevent a high pressure in the line 5 from being communicated back to the secondary cylinder 13 in the return or suction stroke of the piston 11. Also, a suction valve 18 is provided which is openable to permit fluid to be sucked in the chamber 13A of the secondary cylinder 13.

A shortcircuit line 19 branches off a fluid return line 20B of the servo valve 4 and hydraulically connects to the high pressure supply line 5. This branch line 19 functions such that in a suction stroke of the piston 11 the fluid discharged from the primary cylinder 12 is partly sucked into the secondary cylinder 13. The suction valve 18 is installed in this shortcircuit 19.

Output signals of the sequence circuit 16 are coupled to the shut-off valve 17, suction valve 18 and a high pressure relief valve 23 to control their operations. The valve 23 is adapted to relieve the high pressure line 5 to a reservoir 22 in a position downstream of the shut-off valve 17 in a state of emergency.

Apart from the operations of the valves 17, 18 and 23, the sequence circuit 16 also controls the rotation of an electric motor 25 for driving a hydraulic pump 24 at the fluid source 7 and operations of a display unit 31 for indicating a developed high pressure and an alarm unit 32 responsive to failures. Details of such controls of the sequence circuit 16 will be described later with reference to a flowchart shown in FIG. 2.

The pump 24 at the fluid source 7 discharges fluid within a usual pressure range. In addition to the pump 24, the fluid source 7 comprises a pressure control valve or relief valve 26 for controlling the discharge pressure of the pump 24 to a predetermined level and an accumulator 27 for accumulating the controlled fluid pressure.

Fluid under pressure is thus supplied from the fluid source 7 to the servo valve 4 via a supply line 20A which extends therebetween. The servo valve 4 feeds the input fluid to the primary cylinder 12 of the boost cylinder 8 while controlling its flow rate. The fluid will be returned or drained from the primary cylinder 12 back into the reservoir 22 via a return conduit 20B.

As will be noted, the operation of the pump 24 is stopped when the fluid pressure in the supply line 20A increases or decreases beyond a usual level and/or when the liquid level in the reservoir 22 is lowered beyond a given allowable level.

The high pressure supply line 5 is in fluid communication with a variable crown roll 40 of a rolling mill through a line 41. Thus, high pressure fluid from the line 5 is communicated to the roll 40 to crown it between opposite bearings associated therewith.

The stationary line 41 is connected with the rotating variable crown roll 40 by a rotary joint 42. To cool the rotary joint 42, an excessive part of fluid from the pressure control valve 26 is circulated through the joint via inlet and outlet cooling lines 43A and 43B.

Referring to FIG. 2, general operations of the illustrated system for pressurizing fluid will be described.

At a start of operation, a breaker on a control panel is turned on to close a power switch. When a start button associated with the pump 24 is depressed, the motor 25 is driven for rotation to cause the pump 24 into discharging actions. The reference pressure setter 1 is loaded with a reference value "0" before the operation is initiated. Thus, simultaneously with a start of actions of the pump 24, fluid under pressure is fed into the primary cylinder 12 via the servo valve 4 to move the piston 11 to its intermediate or neutral position where the limit switch $LS_2$ will be turned on.

In the meantime, fluid discharged from the pump 24 is accumulated in the accumulator 27. After all the necessary preparatory conditions have been established in this way, the reference pressure setter 1 has the preset reference value "0" changed to a desired large value.

The output signal of the unit 1 is coupled to the servo valve 4 by way of the servo amplifier 3. Then, the servo valve 4 passes the pressurized fluid from the source 7 to the left chamber 12A in the primary cylinder 12 while draining fluid from the right fluid chamber 12B back to the reservoir 22. Such flows of fluid cause the piston 11 into a rightward stroke so that high pressure fluid pressurized in proportion to the ratio in effective sectional area between the pistons 9 and 10 is forced into the high pressure supply line 5 and then to the roll 40.

The fluid pressure in the line 5 is detected by the sensor 6 whereupon the sensor output is fed back to the adder 2 to be compared with the reference pressure signal also coupled thereto from the unit 1. While the actual fluid pressure in the circuit 5 is lower than the reference fluid pressure, fluid under pressure is continuously fed through the servo valve 4 into the primary side of the booster 8. This causes the piston portion 10 in the secondary cylinder 13 to force fluid into the line 5 until the pressure in the line 5 coincides with the reference pressure. Upon coincidence, the servo valve 4 keeps the booster 8 in the then existing position and thereby maintains the actual pressure in the circuit 5 at the reference level.

A possible condition which disables a desired increase in the fluid pressure is that the piston 11 in the booster 8 reaches an end of its forward stroke before the actual pressure in the circuit 5 coincides with the reference pressure. Another such condition is that the piston 11 gradually strokes to the same stroke end from a position for maintaining a desired pressure due to fluid leakage. This stroke end position of the piston 11 is sensed by the third limit switch $LS_3$ which then urges the sequence circuit 16 to deenergize a solenoid $SOL_2$ associated with the shut-off valve 17. With the shut-off valve 17 thus closed, the then developing pressure in the high pressure supply line 5 is maintained for a moment. Next, a solenoid $SOL_1$ is energized to open the suction valve 18. The servo valve 4 then supplies fluid under pressure into the right chamber 12B of the primary cylinder 12 while returning fluid from the left chamber 12A to the reservoir 22. The result is a leftward displacement of the piston 11 which allows fluid to be sucked via the short-circuit line 19 into the now expanding chamber 13A of the secondary cylinder 13. It will be seen that this suction into the chamber 13A occurs with efficiency because the fluid is constituted by a part of the fluid discharged from the primary cylinder 12.

When the piston 11 of the booster returns to the neutral position, the second limit switch $LS_2$ is turned on to complete the suction stroke. In this situation, the sequence circuit 16 again closes the suction valve 18 and opens the shut-off valve 17 whereby the booster 8 is permitted to resume a pressurizing or discharging operation to maintain the circuit pressure at the reference level.

When it is desired to vary the reference pressure to a second level, a desired value will be loaded in the pressure setter 1 so that the system performs in the same way a feedback control in correspondence with the new reference level.

To lower the pressure in the line 5 down to a selected reference level, the servo valve 4 is actuated by an output signal of the pressure setter 1 to lower the fluid pressure in the left chamber 12A of the primary cylinder 12 this time. The resultant leftward displacement of the piston 11 increases the volume of the chamber 13A of the secondary cylinder 13, whereby the fluid pressure in the line 5 is lowered. Such a displacement of the piston 11 lasts until the actual pressure fed back from the sensor 6 coincides with the selected lower reference level.

In this manner, the boost cylinder 8 can control fluid pressure in the high pressure supply line 5 very accurately to a higher or lower level based on a feedback control and depending on the moving direction of the piston 11.

To complete a pressurizing operation, the pressure setter 1 is manipulated to bring the preset value back to "0" so that the piston 11 is retracted to lower the fluid pressure in the high pressure supply line 5. In detail, as the piston 11 is so retracted to an end of its rearward stroke, the sequence circuit 16 in response to an output of the first limit switch $LS_1$ closes the shut-off valve 17, opens the suction valve 18 and then switches the position of the servo valve 4 such that the piston 11 returns to the neutral position forcing fluid out of the secondary cylinder 13. Then, depressurizing operation is resumed. When the pressure in the line 5 is lowered to "0" level, the pressurizing operation terminates itself automatically with all the initial conditions recovered. Under this condition, the pump switch, power switch and breaker will be opened individually to kill the entire system.

When a failure occurs in the course of a pressurizing operation, the sequence circuit 16 immediately deenergizes the motor 25 at the fluid source 7 and causes the boost cylinder 8 into a retraction mode. If the failure is an abrupt increase in the pressure of the line 5 to an unusual level for example, the sequence circuit 16 energizes a solenoid $SOL_3$ to open the relief valve 23 whereby the high pressure in the line 5 is immediately released to the reservoir 22. In the event of such a failure, the alarm unit 32 is energized to urge an operator to find out a cause of the failure. After removal of the failure, a reset switch will be turned on to bring the mode back to the initial stage of pressurizing operation.

Figure 3:
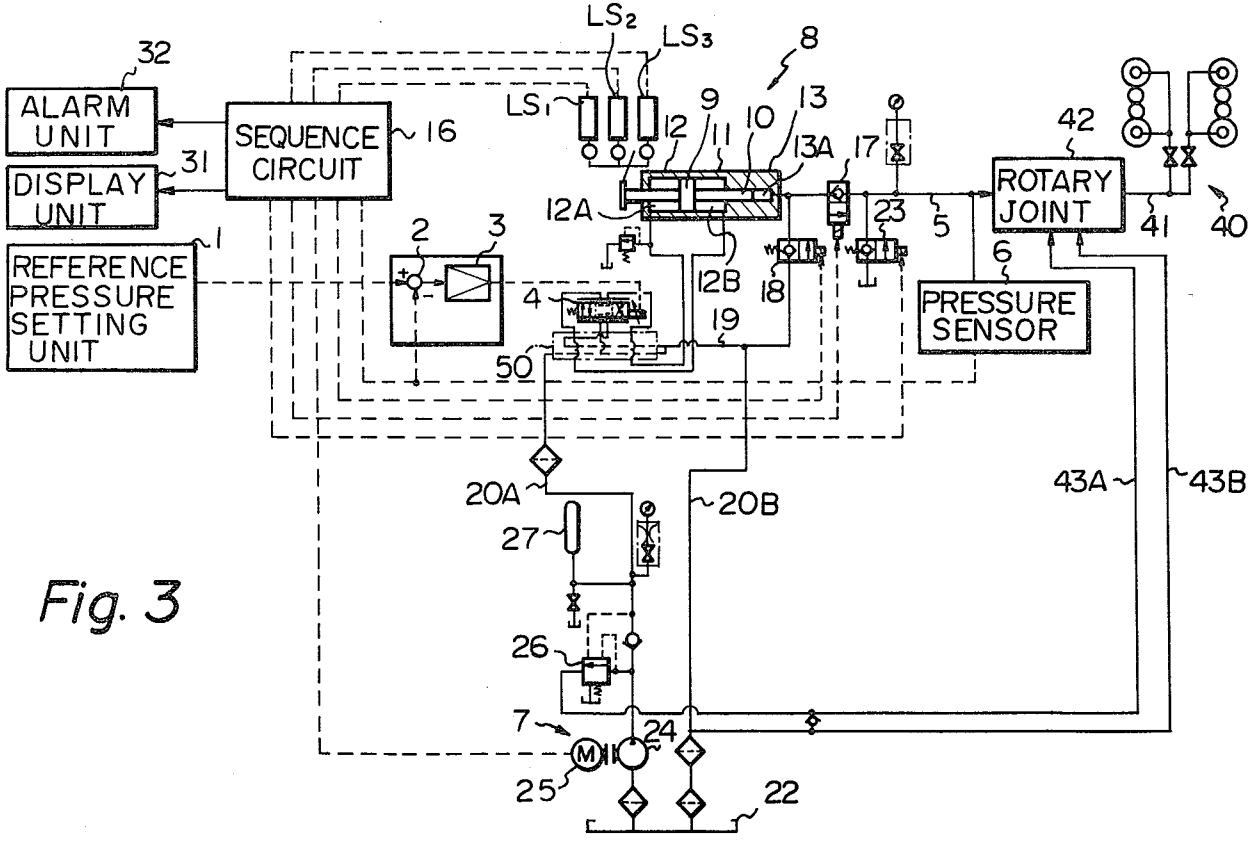
FIGS. 3–5** are diagrams showing other embodiments of the present invention, respectively.

Referring to FIG. 3, there is shown a second embodiment of the present invention which is essentially similar to the first embodiment except that an amplifier valve 50 is additionally installed in the system for cooperation with the electrohydraulic servo valve 4. Instead of the direct control of the pressurized fluid supply to the primary side of the booster 8, the amplifier valve 50 receives a controlled flow from the servo valve 4 as a pilot flow and controls the flow rate to the primary side by proportionally amplifying the pilot flow. In FIG. 3, the same parts and elements as those of FIG. 1 are designated by the same reference numerals.

The amplifier valve 50 is well known per se in the art. In the illustrated arrangement, the amplifier valve 50 controls a large flow rate of fluid based on a small flow rate of pilot flow to quicken a displacement of the piston 11 during pressurization or depressurization and thereby increase or decrease the pressure to a desired level within a short period of time. Another advantage achievable with such a valve 50 is that a servo valve 4 of a relatively small capacity suffices the function and, consequently, a desired elevated pressure can be maintained and controlled stably by virtue of the relatively small flow rate gain of such a servo valve 4.

Figure 4:
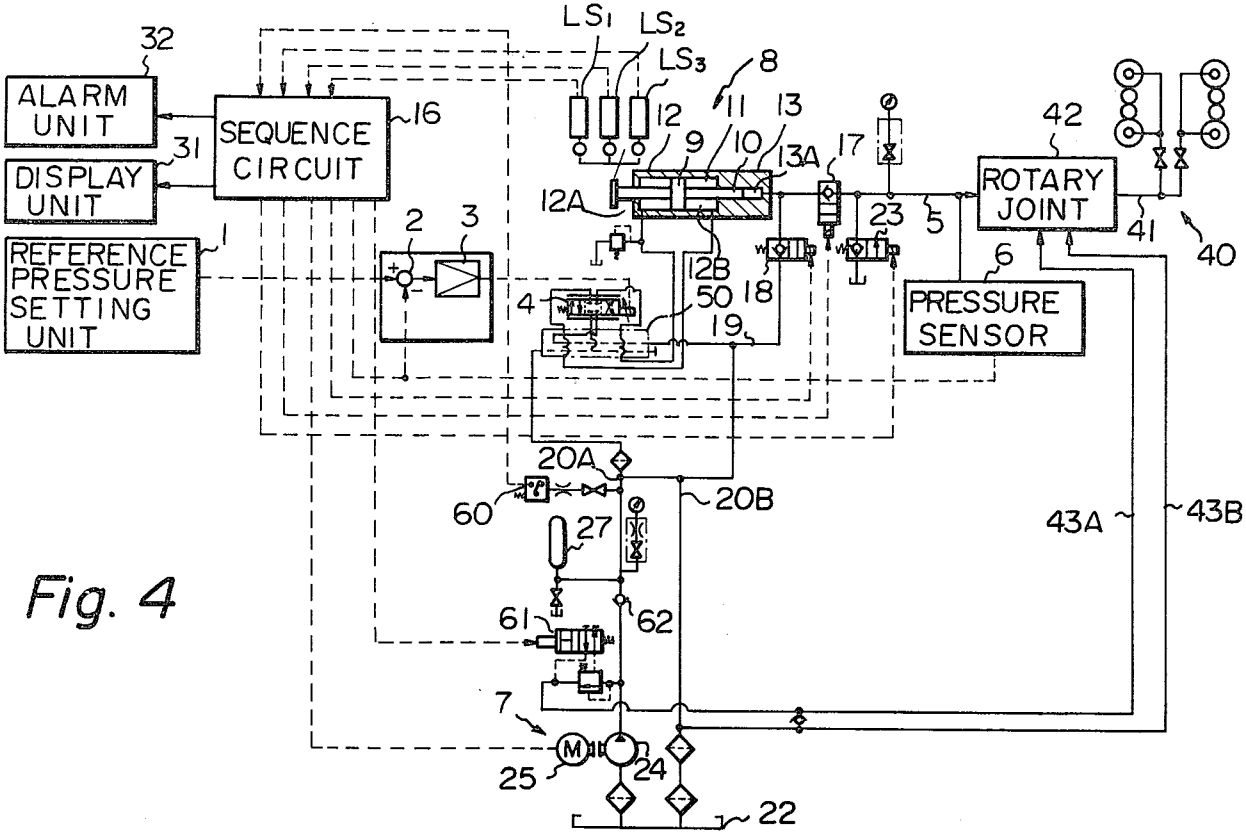

Referring to FIG. 4, a third embodiment of the present invention is illustrated which is essentially similar to the embodiment of FIG. 3 except for addition of some elements for the control on the fluid pressure communicated to the primary side of the boost cylinder 8.

In FIG. 4, a pressure switch 60 senses a fluid pressure developed in the accumulator 27. In response to the output of the pressure switch 60, the sequence circuit 16 controls an electromagnetically operated pressure control valve 61 to its open or closed position. When opened, the pressure control valve 61 releases the fluid pressure from the supply line 20A, which leads from the pump 24, upstream of a check valve 62 into the line 43A. The sequence circuit 16 is designed to open the valve 61 when the pressure switch 60 is turned on in response to a pressure higher than a predetermined level and close the same if otherwise.

Figure 5:
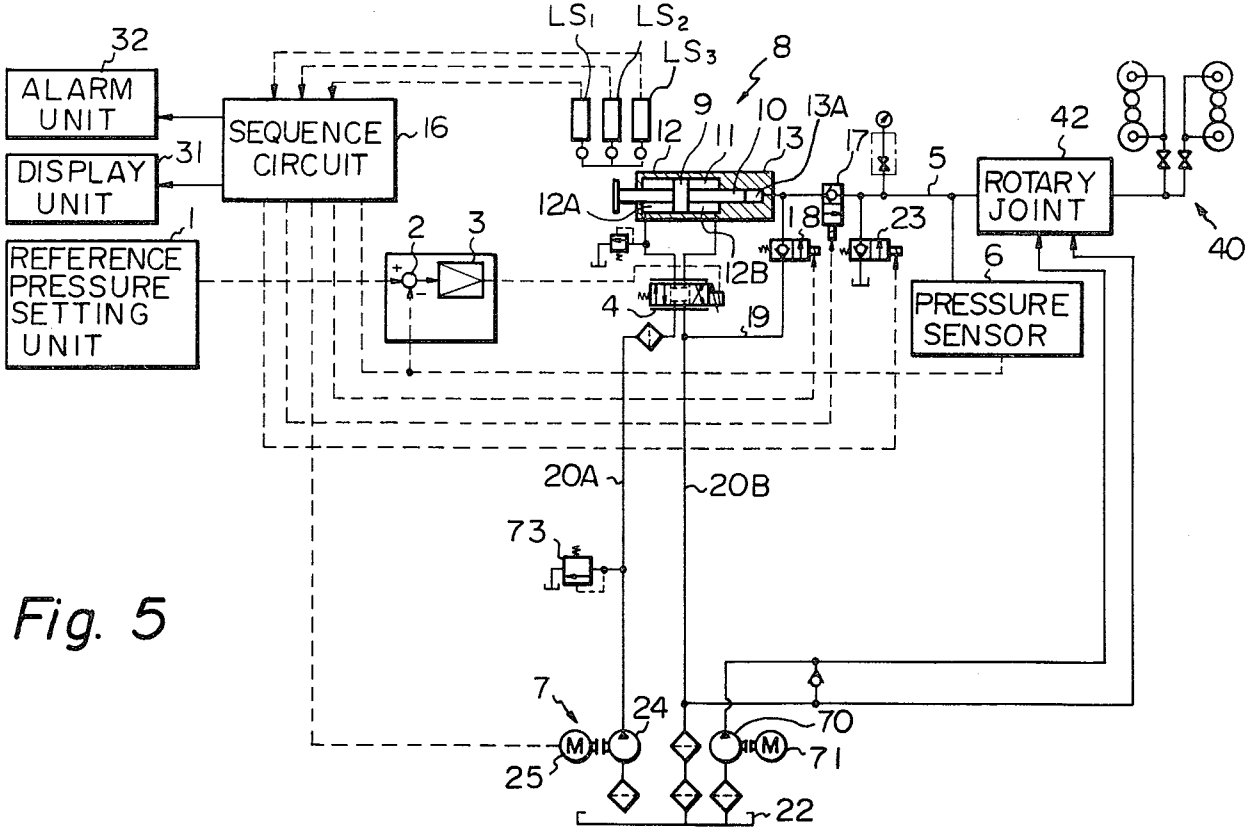

Referring to FIG. 5, there is shown a fourth embodiment of the present invention which employs a second pump 70 for feeding into the conduit 43A fluid for cooling the rotary joint 42 as described in connection with FIG. 1. The pump 70 is driven by an electric motor 71. The fluid pressure supply from the fluid source 7 to the primary side of the booster 8 is controlled by a relief valve 73 which is disposed in the supply conduit 20A.

In summary, it will be seen from the foregoing that the present invention provides a control circuit for a superhigh pressure generation circuit which requires a hydraulic pump for a fluid source to be of only a usual range of delivery pressure. For this reason, compared with a pump of a high pressure design, a power loss in driving the pump is negligible even when a major part of the pump delivery is relieved by a pressure control valve while a desired high pressure is maintained.

Various modifications will become possible for those skilled in the art after receiving the teachings of the present disclosure without departing from the scope thereof.

What is claimed is:

1. A control system for a superhigh pressure generation circuit, comprising:

a pressure setting unit which produces an electric signal representing a preselected pressure;

an electrohydraulic servo valve for controlling an amount of fluid supply from a hydraulic fluid source in response to an output signal of the pressure setting unit;

a boost cylinder having a primary cylinder, a secondary cylinder integral with the primary cylinder and a stepped piston including a first piston portion and a second piston portion, said boost cylinder being constructed to generate a high fluid pressure in the secondary cylinder in response to fluid admitted into the primary cylinder from the servo valve in accordance with the ratio in effective sectional area between the first and second piston portions;

an amplifier valve receiving a controlled flow of fluid from the servo valve as a pilot flow and delivering a larger flow rate of fluid from the fluid source in proportion to the pilot flow, the primary cylinder of the boost cylinder being supplied with a controlled fluid flow from the amplifier valve;

a high pressure supply line into which the generated high pressure is introduced, a pressure sensor sensitive to the fluid pressure in said high pressure supply line, said pressure sensor being constructed to feed the sensed pressure back to the servo valve;

a high pressure relief valve disposed in a line which branches off the high pressure supply line into hydraulic connection with a reservoir, said high pressure relief valve being opened in response to an output signal of the sequence circuit when the fluid pressure in the high pressure supply line is elevated to an unusual level;

a shut-off valve disposed in said high pressure line, a suction line for supplying a fluid supply to said secondary cylinder, a suction valve in said supply line, and a sequence circuit which, when the piston in the boost cylinder reaches an end of a forward or inward stroke thereof, closes the shut-off valve disposed in the high pressure supply line and so switches the fluid pressure in the primary cylinder as to return the piston back to an initial position thereof, said sequence circuit also opening said suction valve in said supply line after said shut-off valve is closed to admit fluid supply to said secondary cylinder as said piston returns back to said initial position.

2. A control system as claimed in claim 1, wherein the fluid source comprises a hydraulic pump, a relief valve for controlling the delivery pressure of the hydraulic pump to a predetermined level and an accumulator for accumulating a control fluid pressure.

3. A control system as claimed in claim 1, wherein the fluid source comprises a hydraulic pump, a pressure sensor responsive to a delivery pressure of the pump, and an electromagnetically operated valve which opens to relieve fluid discharged from the pump when the output of the pressure sensor indicates a pressure higher than a predetermined level.

4. A control system as claimed in claim 1, wherein three limit switches are provided to sense a most retracted position, a neutral position and a most advanced position of the stepped piston in the boost cylinder, respectively, the sequence circuit being supplied with outputs of said three limit switches.

5. A control system as claimed in claim 4 wherein said limit switch which senses the most advanced position of the stepped piston actuates said sequence circuit so that the latter provides a signal to close said shut-off valve, a subsequent signal to open said supply valve, and a signal to actuate said servo valve to supply fluid to said primary cylinder so as to return the piston back to the initial position thereof.

6. A control system as claimed in claim 1, wherein a shortcircuit line is provided to introduce a part of fluid discharged from the primary cylinder into the secondary cylinder during the suction stroke of the boost cylinder from a most advanced position back to a neutral position.

7. A control system as claimed in claim 6, wherein the suction valve blocks the shortcircuit line during the suction stroke of the piston and unblocks the same line after the shut-off valve is closed, both in response to the output signal of the sequence circuit.

8. A control system for a superhigh pressure generation circuit, comprising:

a pressure setting unit which produces an electric signal representing a preselected pressure;

an electrohydraulic servo valve for controlling an amount of fluid supply from a hydraulic fluid source in response to an output signal of the pressure setting unit;

a boost cylinder having a primary cylinder, a secondary cylinder integral with the primary cylinder and a stepped piston including a first piston portion and a second piston portion, said boost cylinder being constructed to generate a super high fluid pressure in the secondary cylinder in response to fluid admitted into the primary cylinder from the servo valve in accordance with the ratio in effective sectional area between th first and second portions;

a high pressure supply line into which the generated superhigh pressure is introduced, a pressure sensor sensitive to the fluid pressure in said high pressure supply line, said pressure sensor being constructed to feed the sensed pressure back to the servo valve;

a shut-off valve disposed in said high pressure supply line;

a suction line for supplying a fluid supply to said secondary cylinder, a suction valve in said supply line, and a sequence circuit which, when the piston in the boost cylinder reaches an end of a forward or inward stroke thereof, closes the shut-off valve disposed in the high pressure supply line and so actuates the servo valve so that fluid pressure in the primary cylinder returns the piston back to an initial position thereof, said sequence circuit also opening said suction valve in said supply line after said shut-off valve is closed to admit fluid supply to said secondary cylinder as said piston returns back to its initial position, whereby the superhigh fluid pressure generated in the secondary cylinder is limited to said secondary cylinder, said high pressure supply line and the section of said supply line upstream of said supply valve.

9. A control system as claimed in claim 8 wherein said suction line is a branch line branching off of said high pressure supply line, said suction valve being disposed in said suction line, whereby the portion of said suction line upstream of said supply valve is exposed to said superhigh pressure and the portion of said suction line downstream of said supply valve is precluded from being exposed to said superhigh pressure.

10. A control system as claimed in claim 9 wherein a short circuit line is provided between said primary cylinder and said branch line such that during the suction stroke of said piston after said shut-off valve has been closed, fluid from said primary cylinder passes through said short circuit line through said open supply valve and said branch line into said secondary cylinder.

* * * * *